US005704661A

United States Patent [19]

Takimoto

[11] Patent Number: 5,704,661

[45] Date of Patent: Jan. 6, 1998

[54] HOLDING ASSEMBLY FOR HOLDING MOVABLE MEMBERS

[75] Inventor: Kazuhide Takimoto, Tokyo, Japan

[73] Assignee: Takigen Manufacturing Co. Ltd., Tokyo, Japan

[21] Appl. No.: 771,116

[22] Filed: Dec. 20, 1996

Related U.S. Application Data

[63] Continuation of Ser. No. 500,343, Jul. 10, 1995, abandoned.

[30] Foreign Application Priority Data

Feb. 3, 1995 [JP] Japan ..... 7-039159

[51] Int. Cl.[6] ..... E05C 1/04

[52] U.S. Cl. ..... 292/162; 163/DIG. 50; 163/DIG. 61

[58] Field of Search ..... 292/162, 32, 42, 292/DIG. 50, DIG. 61, 156, 163, 252

[56] References Cited

U.S. PATENT DOCUMENTS

| | | | |
|---|---|---|---|
| 402,768 | 5/1889 | Reinisch | 70/66 |
| 608,601 | 8/1898 | Henneberg | 292/42 |
| 1,180,943 | 4/1916 | Prażmo | 292/163 |
| 1,548,518 | 8/1925 | Edlich | 292/32 |
| 3,077,359 | 2/1963 | Ettore et al. | 292/3 |
| 4,194,265 | 3/1980 | Zimmerman | 16/82 |
| 4,480,862 | 11/1984 | Fleming | 292/162 |
| 4,482,178 | 11/1984 | Damiana | 292/175 |
| 4,962,800 | 10/1990 | Owiriwo | 150/118 |
| 5,050,915 | 9/1991 | Nwoko | 292/16 |

FOREIGN PATENT DOCUMENTS

| | | | |
|---|---|---|---|
| 3345 | 1/1879 | Germany | 292/42 |
| 303112 | 1/1955 | Switzerland | 292/42 |
| WO 90/14027 | 11/1990 | WIPO | 292/42 |

*Primary Examiner*—Steven N. Meyers
*Assistant Examiner*—Gary Estremsky
*Attorney, Agent, or Firm*—Martin Smolowitz

[57] ABSTRACT

A holding assembly for holding movable members such as doors and the like in their closed positions comprises: a female element 1 fixed to one of a movable member 17 and a stationary member 18; and, a male element 11 fixed to the other thereof. The female element 1 has a slot 36, a right-side wall portion 2 and a left-side wall portion 3 in its central portion so that the walls portions 2, 3 sandwich the slot 36 therebetween. The right-side wall portion 2 and the left-side wall portion 3 are provided with a right hole 4 and a left hole respectively. The male element 11 is constructed of a latch-support frame 8, latches 12, 13 and a casing 19. The latches 12, 13 mounted in the latch-support frame 8 are slidably urged axially outward by a compression coil spring 14. The casing 19 is provided with through-holes 15 and 16 in its right-side and its left-side wall portion through which semi-spheric front-end portions 27 and 28 of the latches 12 and 13 project outward, respectively.

4 Claims, 2 Drawing Sheets

HOLDING ASSEMBLY FOR HOLDING MOVABLE MEMBERS

This application is a continuation of application Ser. No. 08/500,343, filed Jul. 10, 1995 now abandoned.

BACKGROUND OF THE INVENTION

1. Field of the Invention

The present invention relates to a holding assembly for holding movable members such as doors, lids and the like in their closed positions relative to stationary frame members such as machine housings, furniture bodies and the like.

2. Description of the Prior Art

In a conventional holding assembly for holding a movable member such as doors and the like in its closed position: a female element with a slot is mounted on a stationary member and provided with balls in opposite sides of the slot so as to have the balls slidably outwardly urged in a longitudinal direction of the slot under the influence of a resilient force exerted by a spring;. and, the thus resiliently urged balls of the female member having been mounted on the stationary member engage with engaging projections of a male element mounted on the movable member to hold the movable member in its closed position relative to the stationary member.

In this conventional holding assembly for holding doors and the like in their closed positions, for example, in order to hold the door in its closed position, it is necessary for the balls of the female element to firmly hold the engaging projections of the male element, and, therefore it is necessary for the spring for slidably urging the ball outward in the longitudinal direction of the slot of the female element to exert an intensive resilient force.

Consequently, in the conventional holding assembly, due to such intensive resilient force exerted by the spring of the female element, the engaging projections of the male element mounted on the movable member such as doors and the like tend to excessively wear through friction over the balls of the female element when the movable member such as doors and the like is closed and opened, which gradually lessens a force for holding the movable member such as doors and the like in its closed position. This is a problem inherent in the conventional holding assembly for holding doors and the like in their closed positions.

SUMMARY OF THE INVENTION

Consequently, it is an object of the present invention to provide a holding assembly for holding doors and the like in their closed positions relative to a stationary member, which assembly is excellent in durability due to dual slidably-urged latches having ball-shaped front end portions provided in a male element of the holding assembly.

The above object of the present invention is accomplished by providing:

In a holding movable members assembly for holding such as doors and the like in their closed positions, constructed of: a female element fixedly mounted on one of a movable member and a stationary member; and, a male element fixedly mounted on the other of the movable member and the stationary member, the improvement wherein:

the female element is provided with a central slot, a right-side wall portion and a left-side wall portion in its central portion, the wall portions sandwiching the slot therebetween;

the female element right-side wall portion and the left-side wall portion are provided with a right hole and a left hole, respectively;

the male element is constructed of a latch-support frame, a pair of latches and a casing;

the latch-support frame is provided with a pair of seat portions in its left-side and its right-side wall portion;

the seat portions of the latch-support frame are provided with socket holes;

a pair of stop projections for preventing the latches from entering a central portion of the latch-support frame are provided in the central portion of the latch-support frame;

the latches mounted in the latch-support frame are slidably urged outward by a compression coil spring, and provided with flange portions in their base-end outer peripheral portions;

the flange portions abut on the seat portions so as to be prevented from dropping out of the latch-support frame; and the casing for receiving the latch-support frame therein is provided with a pair of through-holes through which a pair of semispheric front-end portions of the latches project outward.

DESCRIPTION OF THE PREFERRED EMBODIMENTS

Figure 1:
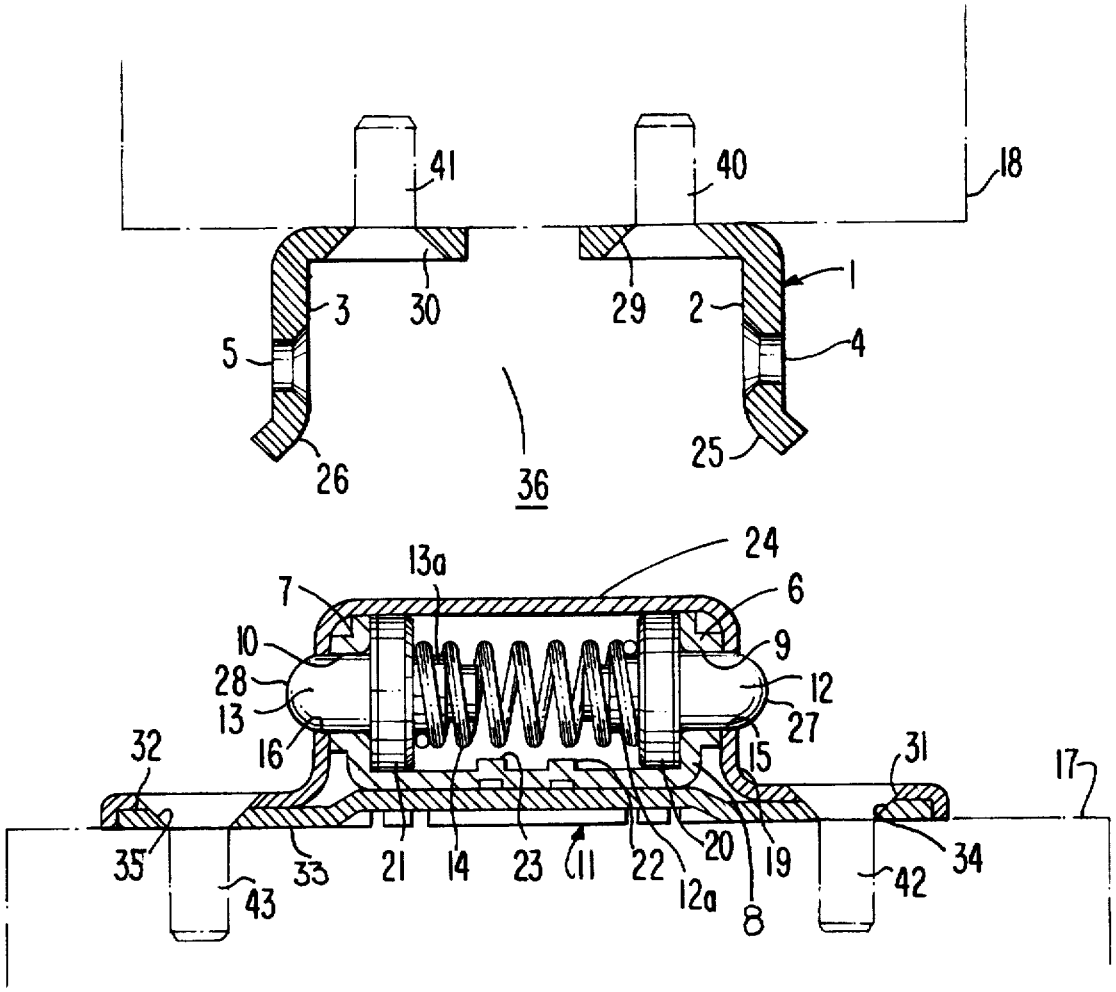
FIG. 1 is a partially sectional view of an embodiment of the holding assembly of the present invention in a condition in which a male element of the holding assembly is separated from a female element thereof.

Hereinbelow, the present invention will be described in detail with reference to the accompanying drawings and the reference numerals and characters therein.

As shown in FIG. 1, a holding assembly of the present invention for holding movable members such as doors and the like in their closed positions relative to a stationary member is constructed of: a female element 1 fixedly mounted on one of a movable member 17 and a stationary member 18; and, a male element 11 fixedly mounted on the other of the movable member 17 and the stationary member 18. The female element 1 is provided with a central slot 36, a right-side wall portion 2 and a left-side wall portion with the 3 in its central portion, the wall portions 2, 3 sandwiching the slot 36 therebetween; the right-side wall portion 2 and the left-side wall portion 8 are provided with a right hole 4 and a left hole 5, respectively. The male element 11 is constructed of a latch-support frame 8, which retains a pair of axially slidable latches 12, 13 and a casing 19 which encloses the latch support frame 8.

The latch-support frame 8 is provided with a pair of seat portions 6, 7 in its left-side and its right-side wall portion, respectively. The seat portions 6 and 7 of the latch-support frame 8 are provided with socket holes 9 and 10, respectively through which the slidable latches 12, 13 extend outwardly. A pair of stop projections 22, 23 for preventing the latches 12, 13 from entering a central portion of the latch-support frame 8 are provided in the central portion of the latch-support frame 8. The latches 12 and 13 mounted in the latch-support frame 8 are axially slidably urged outward by a compression coil spring 14, and provided with flange portions 20 and 21 in their base-end outer peripheral portions, respectively. The flange portions 20 and 21 abut on the seat portions 6 and 7, respectively, so as to be prevented from dropping out of the latch-support frame 8. The casing 19 for receiving the latch-support frame 8 therein is provided with a pair of through-holes 15 and 16 through which a pair of ball-shaped or semispheric front-end portions 27 and 28 of the latches 12 and 13 project axially outward, respectively and through both socket holes 9, 10 in the latch-support frame 8 before the through holes 15, 16 in the casing 19.

In the holding assembly of the present invention for holding doors and the like in their closed positions, as shown in FIG. 1, when the movable member or door 17 is closed relative to the stationary frame 18, the male element 11 reaches the female element 1 so that a front portion 24 of the male element 11 enters a slot 36 provided in a central portion of the female element 1. Then, when front-end portions 27 and 28 of the latches 12 and 13 of the male element 11 is forcibly inserted into open-edge portions 25 and 26 of the opposite side wall portions 2 and 3 of the female element 1, respectively, latches 12 and 13 are axially moved inward in the casing 19 against a resilient force exerted by the compression coil spring 14 in the through-holes 15 and 18 of the casing 19 of the male element 11, respectively.

Figure 2:
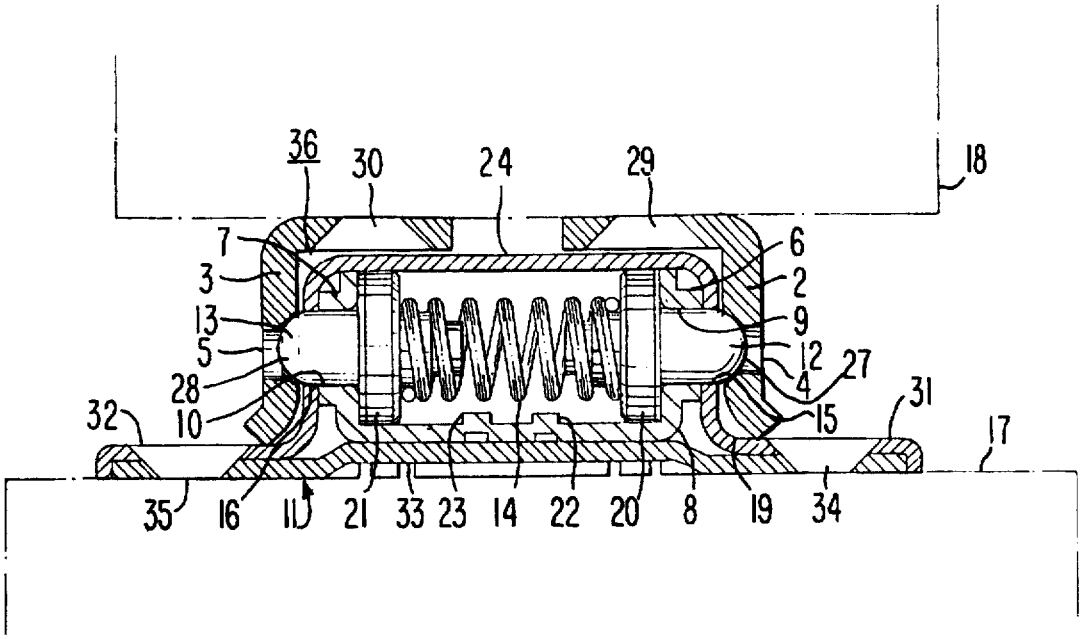
FIG. 2 is a partial sectional view of the holding assembly of the present invention shown in FIG. 1 in a condition in which the male element of the holding assembly mates with the female element thereof.

After completion of insertion of the semispheric front-end portions 27 and 28 of the latches 12 and 13 into the right hole 4 and the left hole 5 of the female element 1, respectively, the latches 12 and 13 move again axially outward in the casing 19 to have their semispheric front-end portions 27 and 28 abut on axially inner peripheral surfaces of the holes 4 and 5, respectively. As a result, as is clear from FIG. 2, the movable member 17 such as doors and the like is held in its completely closed position relative to the stationary member 18.

In opening operation of the movable member or door 17, the latches 12 and 13 abutting on the axially inner peripheral surfaces of the holes 4 and 5 of the female member i are temporarily moved axially inward in the through-holes 15 and 16 of the male member 1, respectively. Then, when the semispheric front-end portions 27 and 28 of the latches 12 and 13 pass through the open-edge portions 25 and 26 of the female element 1, respectively, the latches 12 and 13 move again axially outward in the casing 19 under the influence of a resilient force exerted by the compression coil spring 14 to have the movable member 17 be free from the stationary frame 18. When the male element 11 is free from the female element 1, the flange portions 20 and 21 of the base-end outer peripheral portions of the latches 12 and 13 abut on the seat portions 6 and 7 of the through-holes 9 and 10, respectively, so that the latches 12, 13 are held in their rest positions in the casing 19, as shown in FIG. 1.

In the embodiment of the holding assembly of the present invention for holding movable members such as doors and the like in their closed positions relative to a stationary member, the female element 1 is fixedly mounted on the stationary frame 18 by screws 40 and 41 which pass through mounting holes 29 and 30 of the female element 1, respectively. The open-edge portions 25 and 26 forming guide surfaces of the female element 1 are formed by bending the side wall portions 2 and 3 of the female element 1 outward, respectively. The holes 4 and 5 of the female element 1 have their axially inner peripheral surfaces formed into conical shapes, as is clear from FIG. 1.

In the male element 11, the latch-support plate 8 is fixedly mounted within the casing 19. The compression coil spring 14 has its opposite ends appropriately fitted on base-end small-diameter portions 12*a*, 13*a* of the latches 12, 13. The male element 11 is fixedly mounted on the movable member 17 by screws 42 and 43 which pass through mounting holes 31 and 32 of opposite end portions of the casing 19 and also pass through mounting holes 34 and 35 of a mounting plate 33, respectively. The mounting plate 33 contacts the latch support frame 8 lower side and the opposite end portions of the casing 19 lower side, and is enclosed by the casing 19 and disposed in contact with the lower side of the male element 11.

In the holding assembly of the present invention having the above construction: the female element 1 mounted on one of the movable member 17 and the stationary frame 18 is provided with holes 4, 5; and, the male element 11 mounted on the other thereof is provided with the latch-support frame 8 which receives the latches 12, 13 therein to have the latches 12, 13 slidably urged axially outward in the frame 8 under the influence of the resilient force exerted by the compression coil spring 14, so that the semispheric front-end portions 27 and 28 of the latches 12 and 13 project axially outward through the through-holes 15 and 16 of the casing 19 of the male element 11, respectively. Consequently, it is possible to improve the holding assembly of the present invention in durability of the engaging projections of the male element 11 thereof.

What is claimed is:

1. In a holding assembly for holding movable members in their closed positions relative to a stationary member, consisting of: a female element (1) for fixedly mounting on one of a movable member (17) and a stationary member (18); and a male element (11) for fixedly mounting on the other of said movable member (17) and said stationary member (18), the improvement wherein:

said female element (1) is provided with a central slot (36), a right-side wall portion (2) and a left-side wall portion (3) in the element central portion, said wall portions (2, 3) sandwiching said slot (36) therebetween; said right-side wall portion (2) and said left-side wall portion (3) being provided with a right hole (4) and a left hole (5), respectively;

said male element (11) is constructed of a latch-support time (8) which retains a pair of axially slidable latches (12, 13), a casing (19) which encloses the latch-support frame (8); and a mounting plate (33) which is enclosed by said casing (19);

said latch-support frame (8) is provided with a pair of seat portions (6, 7) located in its left-side and its right-side wall portion, respectively;

said seat portions (6) and (7) of the latch-support frame (8) are provided with socket holes (9) and (10), respectively; through which the slidable latches (12, 13) extend outwardly;

a pair of stop projections (22, 23) for preventing said axially slidable latches (12, 13) from entering a central portion of said latch-support frame (8) are provided in said central portion of said latch-support frame (8);

said latches (12) and (13) mounted in said latch-support frame (8) are axially slidably urged outward by a compression coil spring (14), and are provided with flange portions (20) and (21) in their base-end outer peripheral portions, respectively;

said flange portions (20) and (21) abut on said seat portions (6) and (7) respectively, so that said latches (12) and (13) are prevented from dropping out of said latch-support frame (8); and said casing (19) for receiving said latch-support frame (8) therein is provided with a pair of through-holes (15) and (16) through which a pair of semispheric front-end portions (27) and (28) of said axially slidable latches (12) and (13) project respectively, whereby the male element (11) can enter into the slot (36) of the female element (1) and be retained therein by the pair of slidable latches (12, 13) of the male element (11).

2. A holding assembly according to claim 1, wherein said female element (1) is adapted to be fixedly mounted on a stationary frame member (18) by dual screws (40, 41) passing through mounting holes (29, 30) provided within the central slot portion of the female element.

3. A holding assembly according to claim 1, wherein said male element (11) is adapted to be fixedly mounted on a movable door member (17) by dual screws (42, 43) which pass through mounting holes (31, 32) of said casing (19) and pass through mounting holes (34, 35) of a mounting plate (33).

4. In a holding assembly holding a movable member in a closed position relative to a stationary member and including movable member (17) and a stationary member (18) and a male element (11) fixedly mounted on the other of said movable member (17) and said stationary member (18), the improvement wherein:

said female element (1) is provided with a central slot (36), a right side wall portion (2) and a left-side wall portion (3) in the element central portion, said wall portions (2,3) sandwiching said slot (36) therebetween; said right-side wall portion (2) and said left-side wall portion (3) being provided with a right hole (4) and a left hole (5) respectively; and said female element (1) is fixedly mounted on a stationary frame member (18) by dual screws (40, 41) which pass through mounting holes (29,30) provided within the central slot portion of the female element;

said male element (11) is constructed of a latch support frame (8) which retains a pair of axially slidable latches (12,13), a casing (19) which encloses the latch-support frame (8); and a mounting plate (33) which is enclosed by said casing (19);

said male element (11) is fixedly mounted on a movable member (17) by dual screws (42,43) which pass through mounting holes (31,32) of said casing (19) and also pass through mounting holes (34,35) of the mounting plate (33);

said latch-support frame (8) is provided with a pair of seat portions (6,7) located in its left-side and its right-side wall portion respectively;

said seat portions (6) and (7) of the latch-support frame (8) are provided with socket holes (9) and (10) respectively; through which the slidable latches (12, 13) extend outwardly;

a pair of stop projections (22, 23) for preventing said axially slidable latches (12, 13) from entering a central portion of said latch-support frame (8) are provided in said central portion of said latch-support frame (8);

said latches (12) and (13) mounted in said latch-support frame (8) are axially slidably urged outward by a compression coil spring (14), and are provided with flange portions (20) and (21) in their base-end outer peripheral portions, respectively;

said flange portions (20) and (21) abut on said seat portions (6) and (7) respectively, so that said latches (12) and (13) are prevented from dropping out of said latch-support frame (8); and said casing (19) for receiving said latch-support frame (8) therein is provided with a pair of through-holes (15) and (16) through which a pair of semispheric front-end portions (27) and (28) of said axially slidable latches (12) and (13) project respectively, whereby the male element (11) can enter into the slot (36) of the female element (1) and be retained therein by the pair of slidable latches (12, 13) of the male element (11).

* * * * *